US009390822B2

(12) United States Patent
Park et al.

(10) Patent No.: US 9,390,822 B2
(45) Date of Patent: Jul. 12, 2016

(54) OXIDATION DECONTAMINATION REAGENT FOR REMOVAL OF THE DENSE RADIOACTIVE OXIDE LAYER ON THE METAL SURFACE AND OXIDATION DECONTAMINATION METHOD USING THE SAME

(71) Applicant: KOREA ATOMIC ENERGY RESEARCH INSTITUTE, Daejeon (KR)

(72) Inventors: Sang Yoon Park, Daejeon (KR); Hui-Jun Won, Daejeon (KR); Wangkyu Choi, Daejeon (KR); Jeikwon Moon, Daejeon (KR); Chong-Hun Jung, Daejeon (KR); In-Ho Yoon, Gwangju (KR); Jun-Young Jung, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 195 days.

(21) Appl. No.: 14/304,744

(22) Filed: Jun. 13, 2014

(65) Prior Publication Data

US 2014/0378733 A1 Dec. 25, 2014

(30) Foreign Application Priority Data

Jun. 19, 2013 (KR) ..... 10-2013-0070500

(51) Int. Cl.

| | |
|---|---|
| ***G21F 9/00*** | (2006.01) |
| ***C23F 15/00*** | (2006.01) |
| ***G21F 9/28*** | (2006.01) |
| ***C23G 1/08*** | (2006.01) |
| ***C23G 1/10*** | (2006.01) |

(52) U.S. Cl.

CPC ..... *G21F 9/004* (2013.01); *C23F 15/00* (2013.01); *C23G 1/085* (2013.01); *C23G 1/10* (2013.01); *G21F 9/28* (2013.01)

(58) Field of Classification Search

None

See application file for complete search history.

(56) References Cited

U.S. PATENT DOCUMENTS

| | | | | |
|---|---|---|---|---|
| 4,226,640 | A * | 10/1980 | Bertholdt | G21F 9/28 134/28 |
| 6,504,077 | B1 * | 1/2003 | Purohit | G21F 9/004 423/10 |
| 2010/0168497 | A1 * | 7/2010 | Enda | G21F 9/002 588/1 |
| 2012/0138086 | A1 * | 6/2012 | Gassen | G21F 9/004 134/3 |

FOREIGN PATENT DOCUMENTS

| | | |
|---|---|---|
| JP | 52-024137 | 2/1977 |
| JP | 58-048900 | 3/1983 |
| JP | 03-219092 | 9/1991 |
| JP | 1997-203797 | 8/1997 |
| JP | 2002-250794 | 9/2002 |
| JP | 2004-286471 | 10/2004 |
| JP | 2011-26636 | 2/2011 |
| KR | 1020010108013 | 12/2001 |
| KR | 1020040013783 | 2/2004 |
| KR | 1020080056846 | 6/2008 |

* cited by examiner

*Primary Examiner* — Melvin C Mayes
*Assistant Examiner* — Sheng H Davis
(74) *Attorney, Agent, or Firm* — Lathrop & Gage LLP

(57) ABSTRACT

The present invention provides an oxidative decontamination reagent for removal of the dense radioactive oxide layer on a metal surface, which comprises an oxidizing agent, a metal ion, and an inorganic acid. The oxidative decontamination reagent of the present invention is characteristically prepared by adding a metal ion to the conventional oxidative decontamination reagent containing an oxidizing agent and an inorganic acid. When the oxidative decontamination reagent of the present invention is used, electric potential of the metal parts of the primary system of the nuclear power plant can be regulated as passive potential owing to the added metal ion during the oxidative decontamination of the primary metal part of the nuclear power plant. Therefore, by maintaining electric potential of the metal part as passive potential, local corrosion can be inhibited and at the same time secondary waste can be significantly reduced.

8 Claims, 7 Drawing Sheets

OXIDATION DECONTAMINATION REAGENT FOR REMOVAL OF THE DENSE RADIOACTIVE OXIDE LAYER ON THE METAL SURFACE AND OXIDATION DECONTAMINATION METHOD USING THE SAME

CROSS-REFERENCES TO RELATED APPLICATION

This application claims the benefit of priority from Korean Patent Application No. 10-2013-0070500, filed on Jun. 19, 2013, in the Korean Intellectual Property Office, the contents of which are incorporated herein by reference in its entirety.

BACKGROUND OF THE INVENTION

1. Field of the Invention

The present invention relates to an oxidative decontamination reagent for removal of the dense radioactive oxide layer on the metal surface and a method for oxidative decontamination using the same. More particularly, the invention relates to an oxidative decontamination reagent for removal of the dense radioactive oxide layer on the metal surface including an oxidizing agent, a metal ion, and an inorganic acid, and a method for oxidative decontamination using the same.

2. Description of the Related Art

The major metal parts composing the nuclear power plant system can be corroded by the steam or coolant circulating the nuclear power plant, so that a dense metal oxide can be formed on the metal surface as a minor corrosion product. The metal oxide is contaminated by a radioactive substance, resulting in the accumulation of such radioactive substance in the nuclear power plant system.

Moreover, what makes us more worried is the incidence of radiation exposure to workers in and around the nuclear power plant (for example, the power plant operators and maintenance people), which is inevitable once a radioactive substance is accumulated in the plant system to emit radiation. The metal oxide contains radionuclide which increases the level of radiation around the nuclear power plant system.

As a part of the effort to reduce radiation exposure to the nuclear power plant workers, studies have been focused world-widely on the elimination of radioactivity sticking on the steam generator water chamber and coolant pump. That is, radioactivity has been the major concern and target to reduce radiation exposure to the workers. Up to date, a variety of methods have been tried to eliminate radioactivity and a technique to eliminate metal oxide contaminated by radioactivity is under-development.

The chemical decontamination method is the technique for the decontamination of metal parts of the nuclear power plant system. To perform the optimum decontamination, the radioactive contaminated objectives have to be eliminated along with the corroded oxide layer without damaging metal parts themselves. It is also necessary to minimize the secondary waste produced during the decontamination process.

The conventional methods for the decontamination of the nuclear power plant system depend on nitric permanganate (NP) decontamination reagents and alkaline permanganate (AP) decontamination reagents.

However, the conventional AP decontamination reagent has the disadvantage of massive production of secondary waste even though corrosion resistance on metal parts is excellent. And, NP decontamination reagent has the disadvantage of high corrosion rate of metal parts even though it has the advantage of low production of secondary waste.

The material of the steam generator heat exchanger tube of pressurized water reactor is made of inconel nickel alloy. Residual stress is observed in the part of U-band or expanded tube sheet of such heat pipes, suggesting that the incidence of local corrosion such as stress corrosion cracking (SCC) and intergranular corrosing attack (ICA) is high even during the normal operation of the plant. When those parts showing residual stress are exposed on the oxidative decontamination reagent, the reagent can be permeated through vacancy or cracks in the corroded oxide layer to cause corrosion of the metal parts. When the oxide layer is decomposed during oxidative decontamination, the metal parts are exposed and local corrosion thereon progresses. So, it is requested to develop a method to prevent such local corrosion.

As an example of the conventional methods, Japanese Patent No. 4083607 describes a method and device for chemical decontamination of radioactivity. Particularly, the target substance contaminated by radioactivity is dipped in a decontamination solution containing acid, so that the surface of the target substance is decomposed by lowering electric potential of the target substance up to the level of corroded area therein and then the metal ions in the decontamination solution are eliminated by using cation exchange resin. However, the said chemical decontamination method has a problem of difficulty in prevention of metal part corrosion.

Korean Patent Publication No. 10-2008-0056846 describes a method for diluted chemical decontamination of NP reactor coolant pump internal contaminated by radioactive substance. Particularly, the invention provides a method for decontamination performed in a specific procedure, chemical, concentration, operation time, and operation temperature. However, The inconvenience of this method is that all the conditions for the decontamination have to be altered according to the materials and internals of the nuclear power plant system and the prevention of corrosion of metal parts is still a problem.

Korean Patent Publication No. 10-2001-0108013 describes a method for nuclear power plant decontamination. Particularly, this method is to reduce pollutants from metal parts by reducing adhesiveness of oxide layer on the metal surface by introducing a low concentration of zinc ion into primary coolant of the running boiling water reactor. This method is rather the way to reduce pollutants by zinc injection to the primary coolant of the running reactor than the technique related to decontamination.

In the course of the study to establish a method for oxidative decontamination on metal parts of the nuclear power plant system, the present inventors were succeeded in regulating electric potential of the metal parts to be passive state by adding the decontamination reagent composed of an oxidizing agent, an inorganic acid, and additionally a metal ion, and further developed an oxidative decontamination reagent (MONAP, MOdified Nitric Acid Permanganate) that is characterized by less chance of local corrosion and less secondary waste as well, leading to the completion of the present invention.

SUMMARY OF THE INVENTION

It is an object of the present invention to provide an oxidative decontamination reagent for removal of the dense radioactive oxide layer on the metal surface and a method for oxidative decontamination using the same.

To achieve the above object, the present invention provides an oxidative decontamination reagent for removal of the dense radioactive oxide layer on the metal surface comprising an oxidizing agent, a metal ion, and an inorganic acid.

The present invention also provides a preparation method of an oxidative decontamination reagent comprising the following steps:

preparing a solution by dissolving an oxidizing agent in distilled water (step 1);

adding an inorganic acid to the solution prepared in step 1 (step 2); and adding a metal ion to the solution containing an inorganic acid prepared in step 2 (step 3).

In addition, the present invention provides a method for oxidative decontamination of the primary parts of the nuclear power plant system, which includes the step of contacting the metal part on which the radioactive oxide layer is adhered with the oxidative decontamination reagent.

The present invention further provides a multi-step decontamination method for the primary system parts comprising the following steps:

immersing the metal parts on which the radioactive oxide layer is adhered in the solution containing oxidative decontamination reagent (step 1);

adding a reducing agent to the solution wherein the metal parts of step 1 are immersed (step 2); and purifying the solution after eliminating the metal parts reduced and decontaminated in step 2 (step 3).

Advantageous Effect

The oxidative decontamination reagent of the present invention is prepared by adding a metal ion to the decontamination reagent composed of an oxidizing agent and an inorganic acid. When this oxidative decontamination reagent is used to decontaminate the primary system metal parts of the nuclear power plant, electric potential of the metal parts of the system of the nuclear power plant can be regulated by the metal ion included in the reagent, suggesting that passive potential can be maintained. It is important to keep potential of the metal part to be passive state in order to prevent local corrosion and to reduce secondary waste significantly.

BRIEF DESCRIPTION OF THE DRAWINGS

The application of the preferred embodiments of the present invention is best understood with reference to the accompanying drawings, wherein.

DETAILED DESCRIPTION

Figure 1:
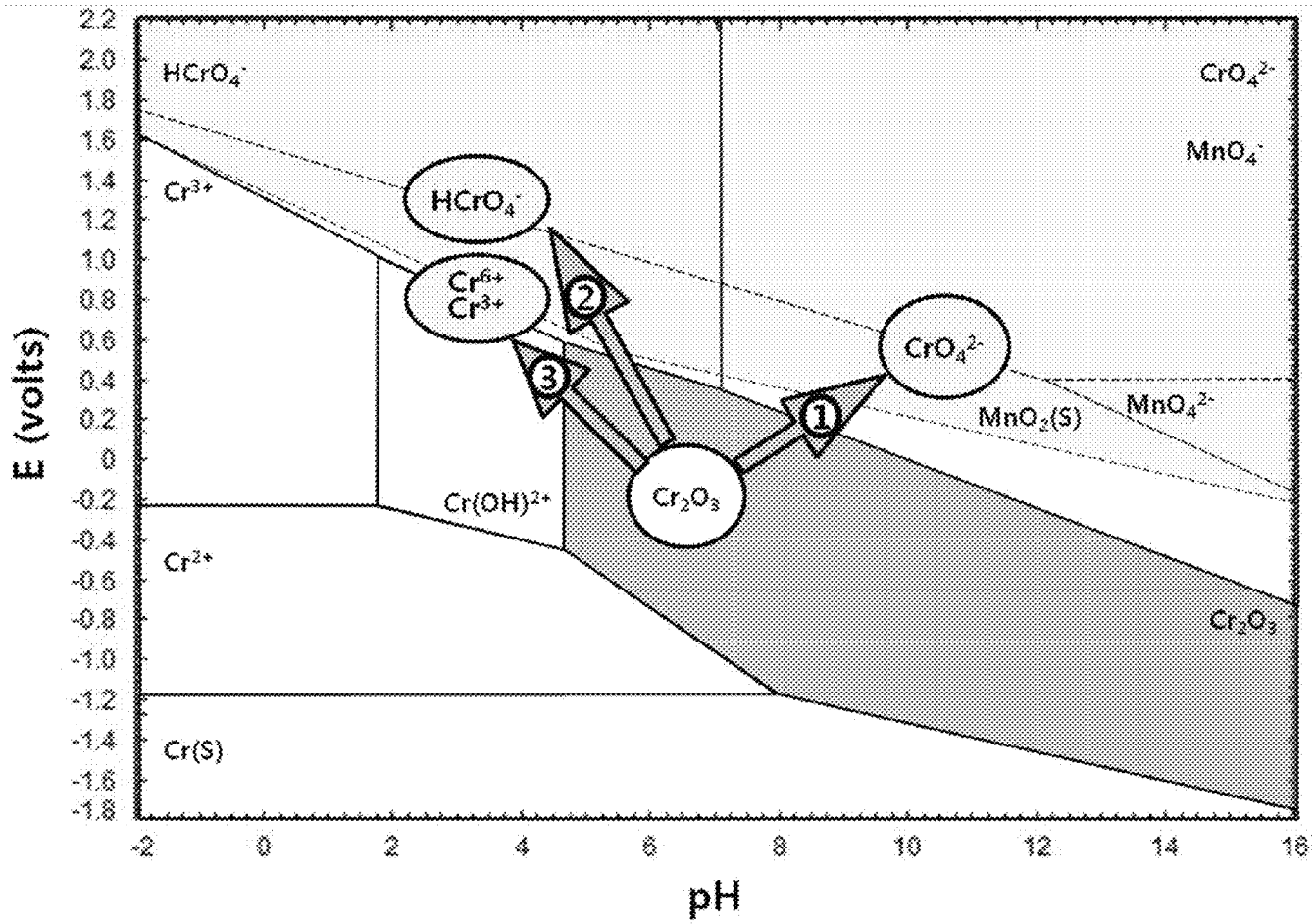
FIG. 1 is a conceptual diagram illustrating the principal of oxidative decontamination using the oxidative decontamination reagent of the present invention.

The present invention provides an oxidative decontamination reagent for removal of the dense radioactive oxide layer on the metal surface comprising an oxidizing agent, a metal ion, and an inorganic acid.

Hereinafter, the oxidative decontamination reagent of the present invention is described in detail.

The conventional oxidative decontamination reagents which have been used up to date are largely classified as alkaline permanganate (AP) decontamination reagents and nitric permanganate (NP) decontamination reagents. The conventional AP decontamination reagent has the disadvantage of massive production of secondary waste even though corrosion resistance on metal parts is excellent. In the meantime, NP decontamination reagent has the disadvantage of high corrosion rate of metal parts even though it has the advantage of low production of secondary waste.

To overcome the above mentioned disadvantages, the present invention provides an oxidative decontamination reagent (MONAP, MOdified Nitric Acid Permanganate) which produces secondary waste less and is advantageous in inhibiting corrosion of metal parts of the system. More particularly, the present invention provides an oxidative decontamination reagent composed of an oxidizing agent, a metal ion, and an inorganic acid for the removal of the dense radioactive oxide layer on the metal surface. The oxidative decontamination reagent of the present invention characteristically includes metal ion, so that it can regulate electric potential of the Nickel base alloy used as a metal part of the nuclear power plant system to be passive potential.

Therefore, the oxidative decontamination reagent of the present invention is a promising oxidative decontamination reagent that can control electric potential of the system to be passive condition so as to prevent corrosion of metal parts in the nuclear power plant system and can reduce secondary waste, significantly.

In the oxidative decontamination reagent of the present invention, the oxidizing agent included therein is selected from the group consisting of $KMnO_4$, $NaMnO_4$, $H_2CrO_4$, and $HMnO_4$.

In the oxidative decontamination reagent of the present invention, the inorganic acid included therein is selected from the group consisting of $HNO_3$, $H_3PO_4$, and $H_2SO_4$.

In the oxidative decontamination reagent of the present invention, the metal ion included therein is selected from the group consisting of $Cu^{2+}$, $Fe^{3+}$, $Cr^{3+}$, $Ni^{2+}$, and $Zn^{2+}$. The addition of such metal ion is advantageous to keep passive potential of metal parts, so that it brings the effect of inhibiting corrosion of the metal parts targeted for oxidative decontamination.

In the oxidative decontamination reagent of the present invention, the dense radioactive oxide layer on the metal surface is generated inside of the nuclear power plant system.

Conceptual diagrams and polarization curves to illustrate the principal of the oxidative decontamination of the present invention are presented in FIG. 1~FIG. 4. The present invention is illustrated in more detail with FIG. 1~FIG. 4 about the principal of the oxidative decontamination by comparing NP oxidative decontamination, AP oxidative decontamination, and MONAP oxidative decontamination of the present invention as examples of oxidative decontamination.

As shown in FIG. 1, oxidative decontamination is the method to dissolve the chroium oxide layer to soluble ion components. In this Figure, the full solid line indicates the potential-pH diagram of Cr—$H_2O$ system at 90° C. and the dotted line indicates the upper part of the potential-pH diagram of Mn—$H_2O$ system.

Chromium oxide known to be insoluble, among many oxide layer components in the primary system of the nuclear power plant, is exemplified by $Cr_2O_3$, $FeCr_2O_4$, and $NiCr_2O_4$. To dissolve such chromium oxide to soluble components such as $CrO_4^{2-}$ and $HCrO_4^-$, oxidative decontamination is used, which is exemplified by (1) AP oxidative decontamination and (2) NP oxidative decontamination, as shown in FIG. 1.

AP oxidative decontamination has a disadvantage of producing a massive secondary waste, while NP oxidative decontamination has a problem of high risk of metal part damage because of high corrosion potential.

On the other hand, as shown in FIG. 1, the method of the present invention, which is MONAP oxidative decontamination, is effective in lowering corrosion potential owing to a very stable metal ion such as $Cu^{2+}$ added to NP oxidative decontamination reagent as a corrosion inhibitor, indicating that the corrosion in metal part that is the disadvantage of the conventional NP oxidative decontamination method can be overcome, and is also effective in reducing secondary waste produced by AP oxidative decontamination.

Figure 2:
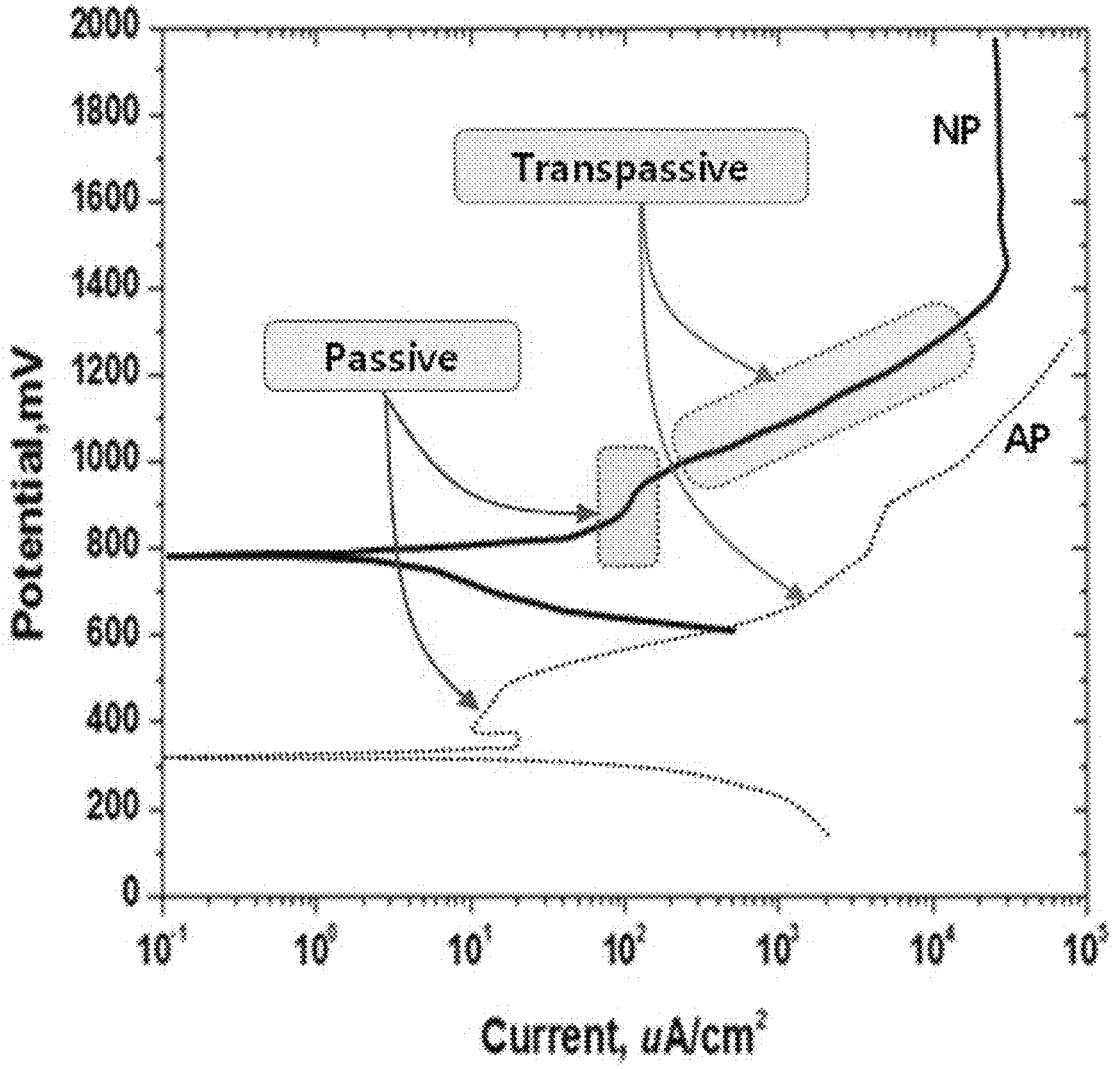
FIG. 2 is a graph illustrating the polarization curve of Nickel base alloy in AP oxidative decontamination and NP oxidative decontamination.

As shown in FIG. 2, it was confirmed in the polarization curve of Nickel base alloy according to the method using the conventional NP and AP oxidative decontamination reagents that wide range of passive area was found which turned into transpassive area at 500 mV or up. In the meantime in the method using NP oxidative decontamination reagent, transpassive area was confirmed at 950 mV or up, similarly to AP oxidative decontamination reagent, but electric current flowing there was 10 times as big in the volume as that of AP oxidative decontamination reagent, and the passive area was much narrower, suggesting higher possibility of corrosion.

Figure 3:
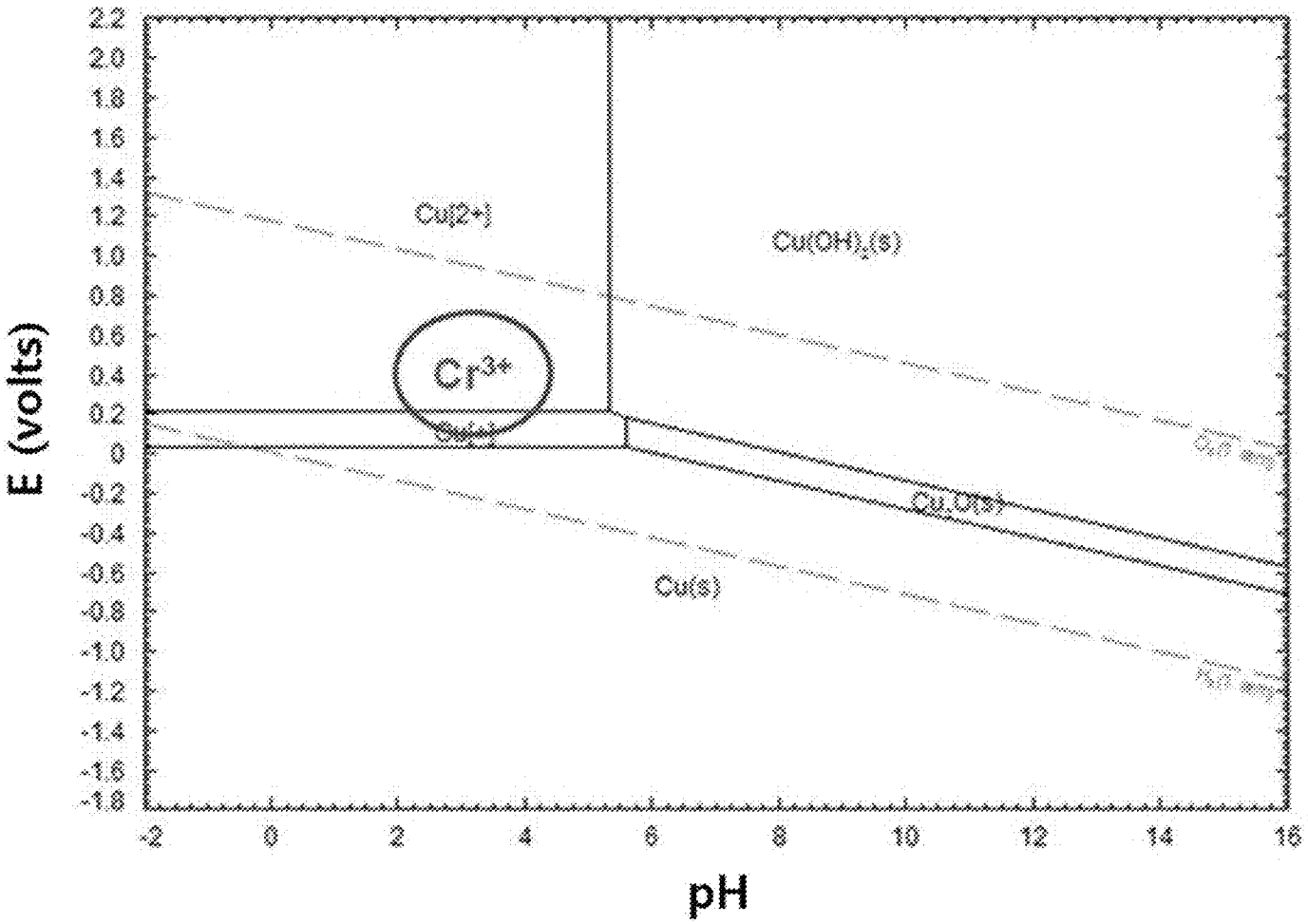
FIG. 3 is a conceptual diagram illustrating the electric potential after the addition of $Cu^{2+}$ included in the oxidative decontamination reagent of the present invention.
Figure 4:
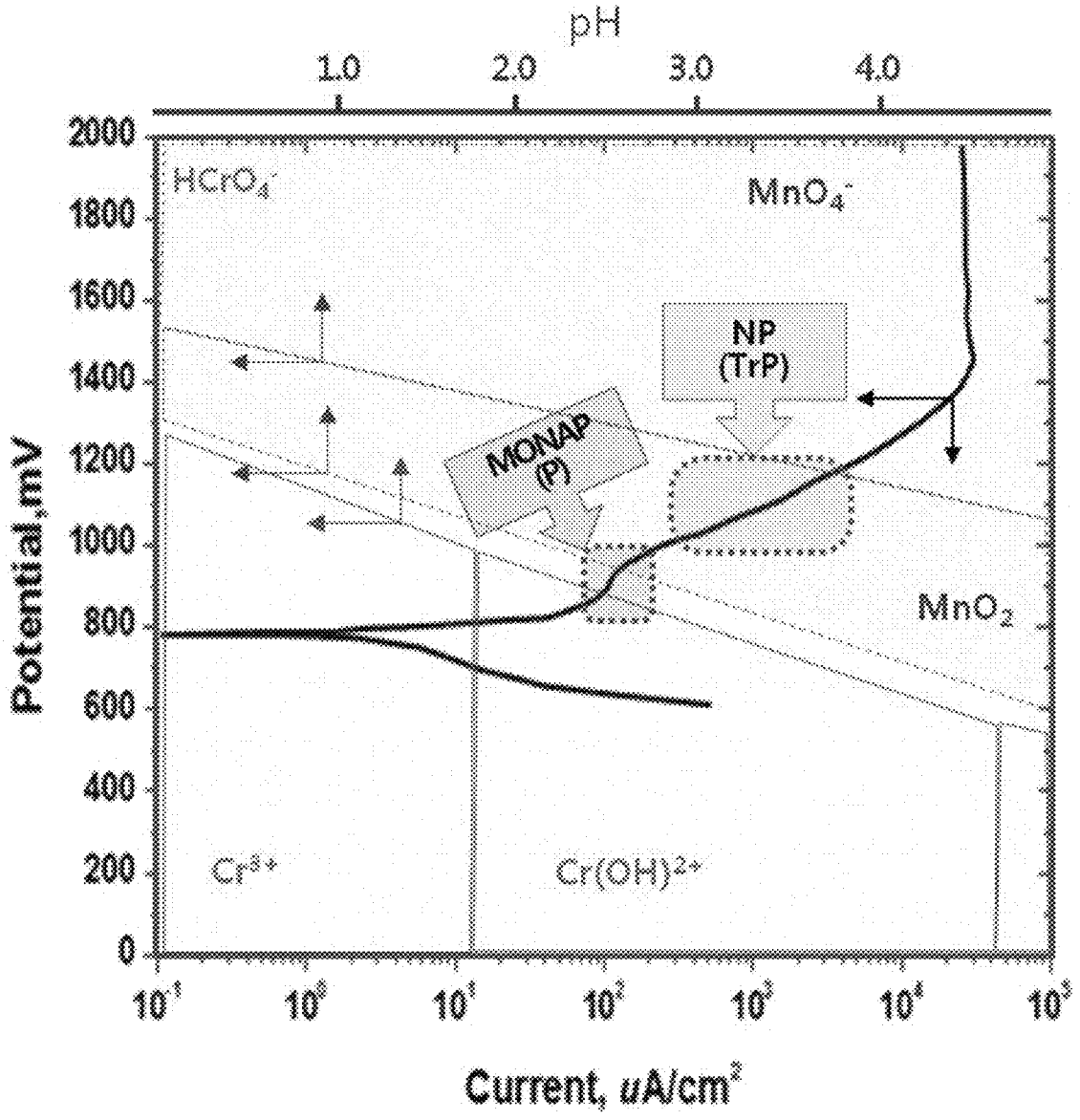
FIG. 4 is a graph illustrating the polarization curve and pH-potential indicating that Nickel base alloy is in passive potential after added with the oxidative decontamination reagent of the present invention.

To overcome the said problems, it is one suggestion to add $Cu^{2+}$ ion to the conventional NP oxidative decontamination reagent, as shown in FIG. 3 and FIG. 4. This addition can move the electric potential to passive area. That is, high risk of general corrosion and local corrosion triggered by high electric potential might be lowered significantly by lowering the potential to the level of border region of $HCrO_4^-$ and $Cr(OH)^{2+}$ which is the region free from local corrosion, so that corrosion resistance of NP oxidative decontamination reagent can be significantly increased.

The corrosion of the major metal parts composing the nuclear power plant system is caused by the steam or cooling water circulating the system. At this time, dense metal oxides can be formed on the metal part surface just as minor corrosive products. The said metal oxides contain radioactive nuclides. The accumulation of such radioactive substances in the system increases the radioactive exposure to workers. Therefore, the oxidative decontamination reagent of the present invention is effective in removal of the dense radioactive oxide layer formed on the metal surface in the nuclear power plant system.

In the oxidative decontamination reagent of the present invention, the metal on which the dense radioactive oxide layer is formed is exemplified by stainless steel, Nickel base alloy, and zirconium alloy, etc.

In the oxidative decontamination reagent of the present invention, the concentration of the oxidizing agent is preferably $1.0\times10^{-5}$~$1.0\times10^{-2}$ M. If the concentration of the oxidizing agent is less than $1.0\times10^{-5}$ M, oxidation is not fully accomplished. If the concentration is more than $1.0\times10^{-2}$ M, a bulk of an additional chemical for the decomposition of the excessive oxidative decontamination reagent remaining after the oxidative decontamination process is required and a problem of producing secondary waste occurs.

In the oxidative decontamination reagent of the present invention, if the metal ion is $Cu^{2+}$ or $Zn^{2+}$, the concentration of such ion is preferably $2\times10^{-5}$~$2\times10^{-3}$ M. If the concentration of such ion is less than $2\times10^{-5}$ M, electric potential is not successively regulated to the passive area. On the other hand, if the concentration is more than $2\times10^{-3}$ M, the precipitation of the metal element is a problem.

In the oxidative decontamination reagent of the present invention, when the metal ion added is neither $Cu^{2+}$ nor $Zn^{2+}$, the concentration of any metal ion herein is preferably $2\times10^{-6}$~$2\times10^{-5}$ M. When the concentration of the metal ion used is less than $2\times10^{-6}$ M, electric potential is not successively regulated to the passive area. On the other hand, if the concentration of the metal ion is more than $2\times10^{-5}$ M, metal precipitation or accelerated corrosion is accompanied, which is not preferred.

In the oxidative decontamination reagent of the present invention, the concentration of the inorganic acid is preferably $1\times10^{-3}$~$3\times10^{-2}$ M. If the concentration of the inorganic acid is less than $1\times10^{-3}$ M, the effect of oxidative decontamination is reduced. If the concentration of the inorganic acid is more than $3\times10^{-2}$ M, a large amount of a neutralizing agent is required to neutralize the excessive inorganic acid, which can accelerate corrosion.

The preferable pH of the oxidative decontamination reagent of the present invention is 1.5~4.8. If the pH is lower than 1.5, metal parts can be corroded easily and if the pH is higher than 4.8, the effect of oxidative decontamination is reduced, which is undesirable.

The present invention also provides a preparation method of an oxidative decontamination reagent comprising the following steps:

preparing a solution by dissolving an oxidizing agent in distilled water (step 1);

adding an inorganic acid to the solution prepared in step 1 (step 2); and adding a metal ion to the solution containing an inorganic acid prepared in step 2 (step 3).

Hereinafter, the preparation method of the oxidative decontamination reagent of the present invention is described in more detail.

In the preparation method of the oxidative decontamination reagent of the present invention, step 1 is to prepare a solution by dissolving an oxidizing agent in distilled water.

The oxidizing agent of step 1 is preferably selected from the group consisting of $KMnO_4$, $NaMnO_4$, $H_2CrO_4$ and $HMnO_4$, and the preferable concentration of such oxidizing agent dissolved in distilled water is $1.0\times10^{-5}$~$1.0\times10^{-2}$ M.

In the preparation method of the oxidative decontamination reagent of the present invention, step 2 is to add an inorganic acid to the solution prepared in step 1.

The inorganic acid added in step 2 is preferably selected from the group consisting of $HNO_3$, $H_3PO_4$ and $H_2SO_4$, and the preferable concentration of the inorganic acid is $1\times10^{-3}$~$3\times10^{-2}$ M.

The inorganic acid of step 2 is functioning to regulate pH of the oxidative decontamination reagent, particularly to regulate the pH in the range of 1.5~4.8.

In the preparation method of the oxidative decontamination reagent of the present invention, step 3 is to add a metal ion to the solution containing an inorganic acid prepared in step 2.

Herein, the metal ion of step 3 is preferably selected from the group consisting of $Cu^{2+}$, $Fe^{3+}$, $Cr^{3+}$, $Ni^{2+}$ and $Zn^{2+}$. When $Cu^{2+}$ or $Zn^{2+}$ is used as the metal ion, the concentration is preferably $2\times10^{-5}$~$2\times10^{-3}$. When the metal ion added herein is neither $Cu^{2+}$ nor $Zn^{2+}$, the concentration of the metal ion is preferably $2\times10^{-6}$~$2\times10^{-5}$ M.

The metal ion of step 3 can be added as each ion or as an ion pair by adding with other metal salt. At this time, the said metal salt is prepared by paring metal cation and metal anion. The anion to be paired herein can be selected from the group consisting of $NO_3^-$, $S_2^-$, $SO_4^{2-}$, $CO_3^{2-}$, $HSO_4^-$, $HCO_3^-$, organic acid anion such as acetate, and halide ion, but not always limited thereto.

The present invention also provides a method for oxidative decontamination of the primary parts of the nuclear power plant system, which includes the step of contacting the metal part on which the radioactive oxide layer is adhered with the oxidative decontamination reagent.

The method for oxidative decontamination of the primary parts of the nuclear power plant system of the present invention can be accomplished by precipitating the metal part on which the dense radioactive oxide layer is adhered in the oxidative decontamination reagent of the invention or making the oxidative decontamination reagent go through the primary system or loop of the nuclear power plant.

It is also preferred to perform the oxidative decontamination of the primary parts of the nuclear power plant system according to the present invention at the temperature range of 70~110° C. If the oxidative decontamination is performed at the temperature lower than 70° C., the effect of oxidative decontamination is reduced. If the temperature is higher than 110° C., the process becomes more complicated because of increased vapor pressure.

It is also preferred to perform the oxidative decontamination of the primary parts of the nuclear power plant system according to the present invention for 2~10 hours. If the time for oxidative decontamination is less than 2 hr, the reaction cannot be completed. If the time for oxidative decontamination is longer than 10 hr, the effect of oxidative decontamination is not going to be increased any more.

The oxidative decontamination of the primary parts of the nuclear power plant system of the present invention is very effective in reducing secondary waste owing to the metal ion added as a corrosion inhibitor and at the same time very effective in preventing corrosion of the primary system parts.

The present invention further provides a multi-step decontamination method for the primary system parts comprising the following steps:

immersing the metal parts on which the radioactive oxide layer is adhered in the solution containing the oxidative decontamination reagent (step 1);

adding a reducing agent (HYBRID) to the solution wherein the metal parts of step 1 are immersed (step 2); and purifying the solution after eliminating the metal parts reduced and decontaminated in step 2 (step 3).

Hereinafter, the multi-step decontamination method for the primary system parts is described step by step.

In the multi-step decontamination method for the primary system parts, step 1 is to immerse the metal parts on which the radioactive oxide layer is adhered in the solution containing the oxidative decontamination reagent In the course of eliminating the radioactive oxide layer from the metal surface by using the solution containing oxidative decontamination reagent, the oxidative decontamination reagent of the invention is more advantageous in reducing secondary waste and at the same time in preventing corrosion of the metal part.

Particularly, the above step is accomplished by immersing the metal parts on which the radioactive oxide layer is adhered in the oxidative decontamination reagent solution.

The preferable temperature of the oxidative decontamination reagent solution is 70~110° C.

The preferable time for the immersion of the metal parts on which the radioactive oxide layer is adhered is 2~10 hours.

In the multi-step decontamination method for the primary system parts, step 2 is to induce reductive decontamination by adding a reducing agent to the solution wherein the metal parts of step 1 is immersed.

Upon completion of the oxidative decontamination including the step of immersing the metal parts in the oxidative decontamination reagent solution, a reducing agent is added to dissolve the corroded oxide layer completely. The said reducing agent plays a role in eliminating the radioactive oxide layer from the metal surface via reduction-dissolution reaction presented by the below reaction formula 1.

$$Fe_3O_4+2e^-+8H^+\rightarrow 3Fe^{2+}+4H_2O \quad \text{[Reaction Formula 1]}$$

($Fe_3O_4$ indicates an iron oxide, an example of the radioactive oxide layer on the metal surface.)

In the multi-step decontamination method for the primary system parts, step 3 is to purify the solution after eliminating the metal parts finished with reductive decontamination in step 2.

The excessive reducing agent remaining in the solution after eliminating the metal parts finished with reductive decontamination can be eliminated by decomposing it with permanganic acid or hydrogen peroxide. The dissolved radionuclide and cation can be eliminated via ion exchange.

Practical and presently preferred embodiments of the present invention are illustrative as shown in the following Examples and Experimental Examples.

However, it will be appreciated that those skilled in the art, on consideration of this disclosure, may make modifications and improvements within the spirit and scope of the present invention.

Example 1

Preparation of an Oxidative Decontamination Reagent (MONAP) 1

An oxidative decontamination reagent was prepared by the following steps:

Step 1: Potassium permanganate ($KMnO_4$, Duksan Pure Chemical Co. Ltd), as an oxidizing agent, was dissolved in distilled water at the concentration of $6\times10^{-3}$ M.

Step 2: Nitric acid ($HNO_3$, Duksan Pure Chemical Co. Ltd), as an inorganic acid, was added to the solution prepared in step 1 at the concentration of $2\times10^{-3}$ M to regulate pH to be 2.7.

Step 3: Copper nitrate ($Cu(NO_3)_2$, Duksan Pure Chemical Co. Ltd), as a metal ion, was added to the solution of step 2 at the concentration of $5\times10^{-4}$ M.

Comparative Example 1

Preparation of the Conventional NP Decontamination Reagent

One of the conventional oxidative decontamination reagent was prepared by the following steps:

Step 1: Potassium permanganate ($KMnO_4$, Duksan Pure Chemical Co. Ltd), as an oxidizing agent, was dissolved in distilled water at the concentration of $6\times10^{-3}$ M.

Step 2: Nitric acid ($HNO_3$, Duksan Pure Chemical Co. Ltd), as an inorganic acid, was added to the solution prepared in step 1 at the concentration of $2\times10^{-3}$ M to regulate pH to be 2.7.

Experimental Example 1

Evaluation of Metal Part Corrosion Rate of the Oxidative Decontamination Reagent To investigate the anti-corrosion effect of the oxidative decontamination reagent of the present invention, general corrosion rate test was performed using the oxidative decontamination reagents prepared in Example 1 and Comparative Example 1 as follows, and the results are presented in FIG. 5.

Particularly, to evaluate general corrosion rate, the metal parts such as nickel base alloy (Special Metals, Inconel-600) and stainless steel (POSCO, 304SS) were immersed in the oxidative decontamination reagents prepared in Example 1 and Comparative Example 1. Upon completion of the oxidative decontamination at 93° C. for 4 hours, the weight loss over the oxidative decontamination was measured.

Figure 5:
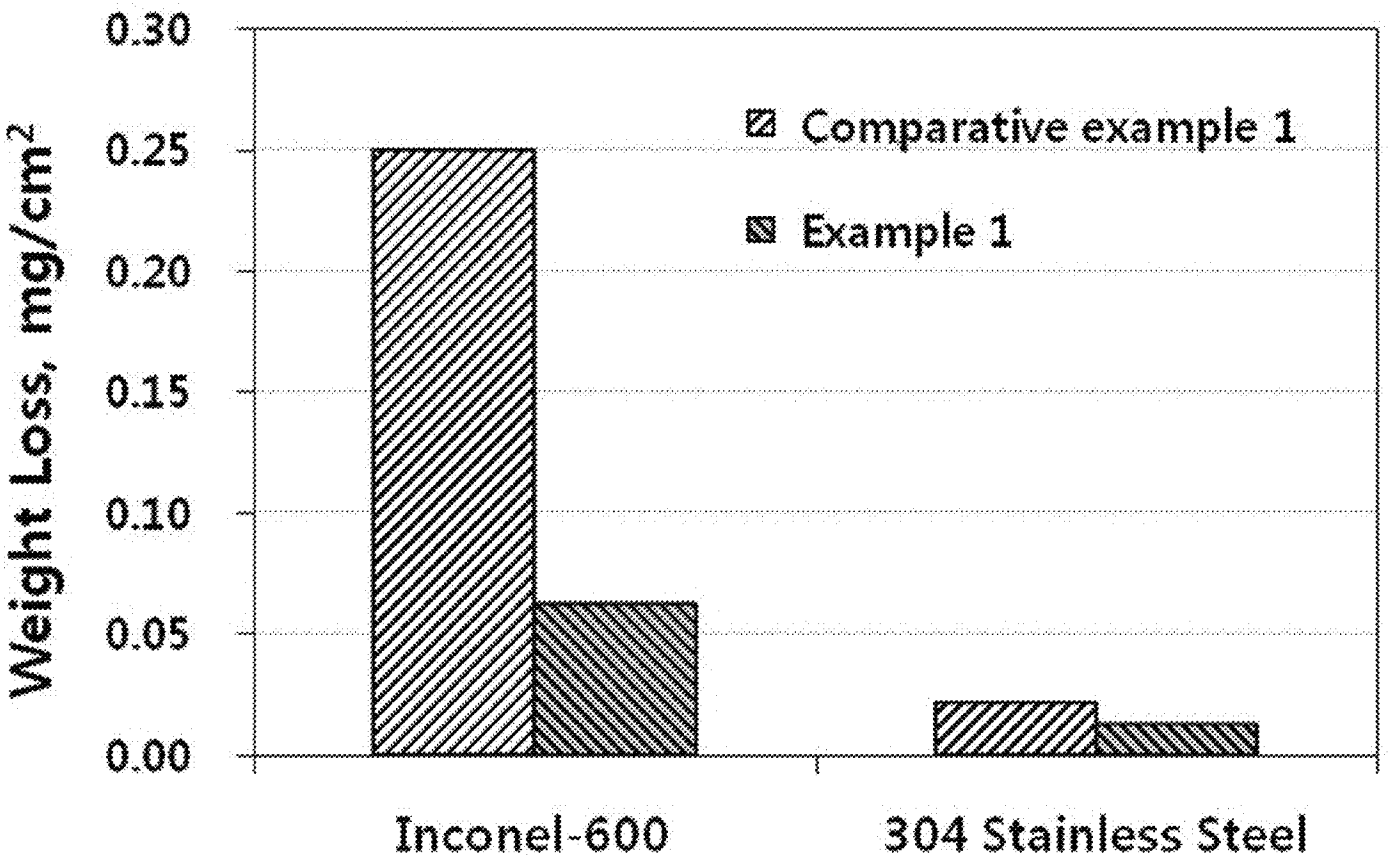
FIG. 5 is a graph illustrating the weight reduction of Nickel base alloy and stainless steel after oxidative decontamination using the oxidative decontamination reagents prepared in Example 1 and Comparative Example 1.

As shown in FIG. 5, there was not much difference in the weight loss over the oxidative decontamination between when stainless steel was immersed in the oxidative decontamination reagent prepared in Example 1 and when stainless steel was immersed in the oxidative decontamination reagent prepared in Comparative Example 1.

When Nickel base alloy was immersed in the oxidative decontamination reagent containing metal ion prepared in Example 1, the weight loss over the oxidative decontamination was approximately 0.06 mg/cm$^2$, which was as small as about 25% by the weight loss (0.25 mg/cm$^2$) over the oxidative decontamination of Nickel base alloy immersed in the oxidative decontamination reagent without metal ion prepared in Comparative Example 1.

Therefore, it was confirmed that the oxidative decontamination reagent of the present invention could reduce corrosion rate significantly, compared with that of the conventional oxidative decontamination reagent, by maintaining passive potential by regulating electric potential of Nickel base alloy with the metal ion added.

Experimental Example 2

Analysis of Local Corrosion on the Surface of Metal Part

Figure 6:
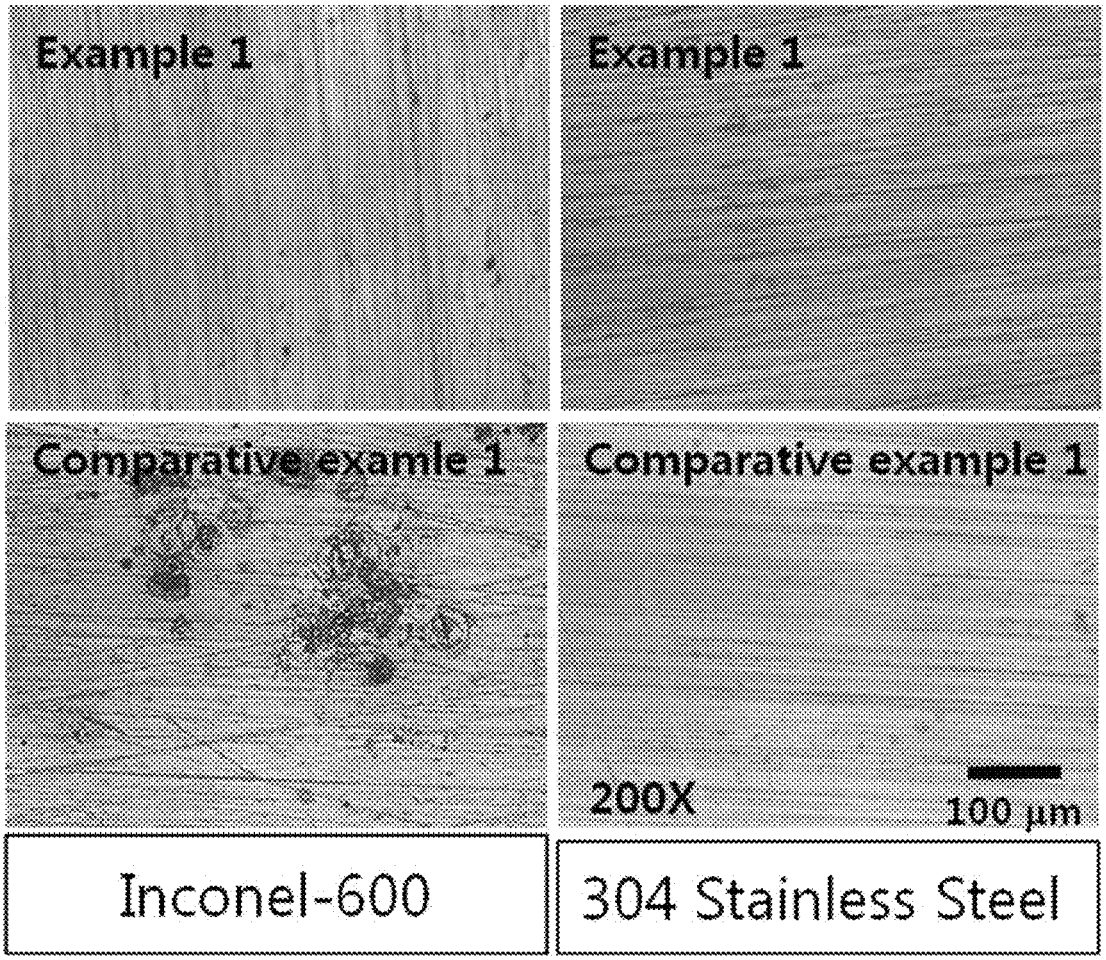
FIG. 6 is a set of photographs illustrating the OM images of Nickel base alloy and stainless steel after oxidative decontamination using the oxidative decontamination reagents prepared in Example 1 and Comparative Example 1.

To investigate the effect of preventing local corrosion of the oxidative decontamination reagent of the present invention, the following experiment was performed with the oxidative decontamination reagents prepared in Example 1 and Comparative Example 1, and the results are shown in FIG. 6.

Particularly, to investigate local corrosion, the metal parts such as Nickel base alloy (Special Metals, Inconel-600) and stainless steel (POSCO, 304SS) were immersed in the oxidative decontamination reagents prepared in Example 1 and Comparative Example 1, followed by oxidative decontamination at 93° C. for 4 hours which are the general conditions for oxidative decontamination. Then, the surface of the Nickel base alloy and stainless steel finished with the oxidative decontamination was observed under optical microscope (OM).

As shown in FIG. 6, when stainless steel was immersed in the oxidative decontamination reagents prepared in Example 1 and Comparative Example 1, local corrosion was hardly observed.

When Nickel base alloy was immersed in the oxidative decontamination reagent without metal ion prepared in Comparative Example 1 for the oxidative decontamination, local corrosion was observed. In the meantime, when Nickel base alloy was immersed in the oxidative decontamination reagent containing metal ion prepared in Example 1 for the oxidative decontamination, local corrosion was hardly observed.

Therefore, it was confirmed that the oxidative decontamination reagent of the present invention could inhibit local corrosion by maintaining passive potential by regulating electric potential of Nickel base alloy with the metal ion added.

Experimental Example 3

Evaluation of Decontamination Rate by Oxidative-Reductive Decontamination Cycle

To investigate the decontamination effect of the oxidative decontamination reagent of the present invention, the contaminated sample which was a copy of the primary system sample of the nuclear power plant was prepared. Oxidative-reductive-oxidative-reductive decontamination was performed stepwise, followed by evaluation of the decontamination effect. The results are shown in FIG. 7.

The oxidative decontamination reagents used herein were the NP decontamination reagent prepared in Comparative Example 1 and the oxidative decontamination reagent (MONAP) of the present invention. The reductive decontamination reagents used herein were HYBRID and Citrox decontamination reagents. These agents were applied twice each.

The sample for the decontamination was picked from the primary system of HANARO fuel test loop, which was running in the same condition as that of the pressurized water reactor primary system. Thus, the sample was presumed to have similar properties to the contaminated sample of the pressurized water reactor primary system.

Figure 7:
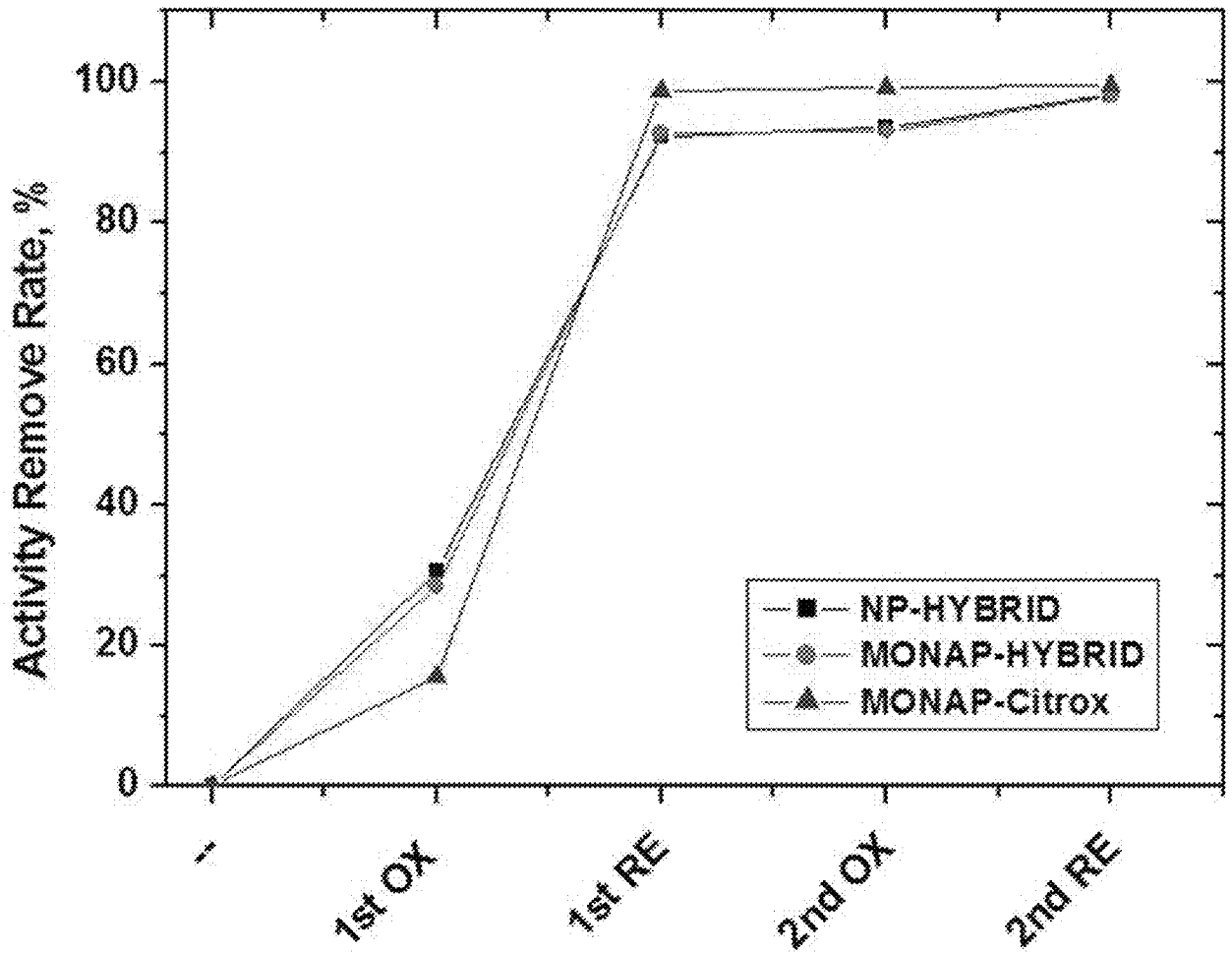
FIG. 7 is a graph illustrating the result of decontamination of contaminated sample obtained from the primary system of research reactor FTL (fuel test loop).

As shown in FIG. 7, NP-HYBRID, MONAP-HYBRID, and MONAP-CITROX were applied. As a result, the decontamination effect was excellent in both MONAP, the oxidative decontamination reagent of the present invention, and the conventional NP decontamination reagent. When 2-cycles of oxidation-reduction were applied, at least 98% of radioactivity was eliminated.

Therefore, the oxidative decontamination reagent of the present invention (MONAP) was confirmed to be effective in inhibiting local corrosion by regulating electric potential of Nickel base alloy to be passive by taking advantage of the metal ion added to the decontamination reagent and the decontamination efficiency was not less than that of the conventional NP decontamination reagent.

What is claimed is:

1. A method of decontamination of a primary system of a nuclear power plant system, comprising:

contacting a metal part of the primary system on which a dense radioactive oxide layer is adhered with an oxidative decontamination reagent, wherein the oxidative decontamination reagent is capable of removing the dense radioactive oxide layer on the metal part, and wherein said reagent comprises an oxidizing agent, a metal ion, and an inorganic acid, wherein the concentration of the oxidizing agent in said reagent is $1\times10^{-5}$–$1\times10^{-2}$ M, the concentration of the inorganic acid in said reagent is $2\times10^{-5}$–$3\times10^{-2}$ M, and wherein the concentration of the metal ion in said reagent is $2\times10^{-5}$–$2\times10^{-3}$ M if the metal ion is $Cu^{2+}$or $Zn^{2+}$, and the concentration of the metal ion is $2\times10^{-6}$–$2\times10^{-5}$ M if the metal ion is neither $Cu^{2+}$nor $Zn^{2+}$.

2. The method of decontamination of a primary system of a nuclear power plant system according to claim 1, wherein the method for oxidative decontamination is performed by immersing the metal part on which the dense radioactive oxide layer is adhered in the oxidative decontamination reagent.

3. The method of decontamination of a primary system of a nuclear power plant system according to claim 1, wherein the method for oxidative decontamination is performed at 70~110° C. for 2~10 hours.

4. The method of decontamination of a primary system of a nuclear power plant system according to claim 1, wherein the oxidizing agent is one or more selected from the group consisting of $KMnO_4$, $NaMnO_4$, $H_2CrO_4$, and $HMnO_4$.

5. The method of decontamination of a primary system of a nuclear power plant system according to claim 1, wherein the metal ion is one or more selected from the group consisting of $Cu^{2+}$, $Fe^{3+}$, $Cr^{3+}$, $Ni^{2+}$, and $Zn^{2+}$.

6. The method of decontamination of a primary system of a nuclear power plant system according to claim 1, wherein the inorganic acid is one or more selected from the group consisting of $HNO_3$, $H_3PO_4$, and $H_2SO_4$.

7. The method of decontamination of a primary system of a nuclear power plant system according to claim 1, wherein the dense radioactive oxide layer on the metal part is observed in the inside of the nuclear power plant system.

8. The method of decontamination of a primary system of a nuclear power plant system according to claim 1, wherein the pH of the oxidative decontamination reagent is 1.5-4.8.

* * * * *